United States Patent [19]

Elder et al.

[11] Patent Number: 4,960,665

[45] Date of Patent: Oct. 2, 1990

[54] TONER AND DEVELOPER COMPOSITIONS CONTAINING ADDITIVES WITH CERTAIN MORPHOLOGIES

[75] Inventors: Fred A. Elder, Webster; Geoffrey M. T. Foley, Fairport; William L. Goffe, Webster, all of N.Y.

[73] Assignee: Xerox Corporation, Stamford, Conn.

[21] Appl. No.: 316,193

[22] Filed: Feb. 27, 1989

[51] Int. Cl.[5] ..... G03G 9/097; G03G 13/22

[52] U.S. Cl. ..... 430/110; 430/111; 430/125; 430/126

[58] Field of Search ..... 430/110, 111, 125

[56] References Cited

U.S. PATENT DOCUMENTS

| | | | |
|---|---|---|---|
| 3,501,294 | 3/1970 | Joseph | 430/125 |
| 3,590,000 | 6/1971 | Palermiti et al. | 430/110 |
| 3,609,082 | 9/1971 | Moriconi et al. | 430/110 |
| 3,655,374 | 4/1972 | Palermiti et al. | 430/121 |
| 3,740,334 | 6/1973 | Jacknow et al. | 430/137 |
| 3,983,045 | 9/1976 | Jugle et al. | 430/110 |

*Primary Examiner*—Roland E. Martin

*Attorney, Agent, or Firm*—E. O. Palazzo

[57] ABSTRACT

A toner composition comprised of resin particles, and a component with a sponge, or non-flake like morphology selected from the group consisting of metal salts, metal salts of fatty acids, and mixtures thereof.

40 Claims, No Drawings

TONER AND DEVELOPER COMPOSITIONS CONTAINING ADDITIVES WITH CERTAIN MORPHOLOGIES

BACKGROUND OF THE INVENTION

This invention is generally directed to toner and developer compositions, and more specifically the present invention is directed to toner compositions, including magnetic, single component, and colored toner compositions containing additives with certain morphologies. In one embodiment of the present invention, the toner compositions are comprised of resin particles, pigment particles, and metal salts of fatty acids, or metal salts with a sponge, or non-flake like morphology. There are also provided in accordance with the present invention positively, or negatively charged toner compositions comprised of resin particles, pigment particles, metal salts of fatty acids, or metal salts, such as zinc stearate, magnesium stearate, and the like, with a sponge like morphology, and optional charge enhancing additives. In addition, the present invention is directed to developer compositions comprised of the aforementioned toners, and carrier particles. Furthermore, in another embodiment of the present invention there are provided single component toner compositions comprised of resin particles, magnetic components, such as magnetites, and metal salts of fatty acids, or metal salts with a sponge, or non-flake like morphology. The toner, and developer compositions of the present invention are useful in electrophotographic imaging systems, especially those systems wherein blade cleaning of the photoconductive member is accomplished. Moreover, the toner and developer compositions of the present invention enable images with excellent resolution, and these compositions possess stable electrical properties for extended time periods. Furthermore, with the toner and developer compositions of the present invention there is enabled substantial uniformity of the toner triboelectric charge; improved toner flow characteristics, reduced undersirable toner impaction on, for example, the imaging member selected, and increased imaging member life. One important advantage associated with the compositions of the present invention reside in improvements in the overall developability of electrostatic latent images and in the uniformity thereof over extended time periods and imaging cycles exceeding, for example, 1,000,000 cycles in some instances in an electrophotographic imaging or printing system. While these characteristics are important in the production of black and white images, they are particularly important for faithful rendition of color images in which multiple primary color images are superimposed, where image densities are typically lower, and where variations in image density and hue are more noticeable than black. There is thus permitted with the compositions of the present invention a more stable development system requiring less complex control systems, and reduced maintenance of the imaging apparatus within which the compositions are incorporated.

Toner and developer compositions with metal salts or metal salts of fatty acids, including the stearates such as zinc stearate, are known reference for example U.S. Pat. Nos. 3,590,000; 3,655,374 and 3,983,045. These stearates, however, do not possess a sponge, or non-flake like morphology thereby enabling the advantages of the present invention. More specifically, the prior art stearates have platelet like morphologies which usually causes excessive accumulation of such stearates in a film on the receptor surface such that xerographic development characteristics may be severely affected in a detrimental manner. Furthermore, such film accumulation has a tendency to occur in an imagewise fashion since the stearate additives are electrostatically charged and tend to deposit preferentially according to the sign and magnitude of the development fields. This imagewise degradation in developability leads specifically to difficulties in maintaining developed image uniformity and to "ghosting". Ghosting refers to the objectionable imagewise modulation of image density within a given print or copy where that imagewise modulation follows image patterns generated on a prior print or copy cycle. The aforementioned disadvantages are alleviated, and/or minimized with the compositions of the present invention. Also, it is known that the aforementioned toner compositions with metal salts of fatty acids can be selected for electrostatic imaging methods wherein blade cleaning of the photoreceptor is accomplished, reference Palermiti et al. U.S. Pat. No. 3,635,704, issued Jan. 18, 1972, the disclosure of which is totally incorporated herein by reference.

Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

There were located as a result of a patentability search U.S. Pat. Nos. 3,501,294; 3,609,082; 3,740,334 and 3,983,045. These references disclose a myriad of stearates and like fatty acid salts in a wide range of particle sizes used as photoreceptor surface lubricants and the effect thereon in the electrophotographic process.

Illustrated in copending application U.S. Ser. No. 004,939/87, the disclosure of which is totally incorporated herein by reference, are toner and developer compositions with linear polymeric alcohols comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions in various effective amounts as finely divided uniformly dispersed external additives. More specifically, the polymeric alcohols are present in an amount of from about 0.05 percent to about 20 percent by weight. Therefore, for example, as external additives the polymeric alcohols are present in an amount of from about 0.05 percent by weight to slightly less than about 5 percent by weight.

The aforementioned copending application also discloses the addition of charge control additives to the toner composition.

Other references of interest which disclose the use of amides as toner additives include U.S. Pat. Nos. 4,072,521; 4,073,649 and 4,076,641. Furthermore, references of background interest are U.S. Pat. Nos. 3,165,420; 3,236,776; 4,145,300; 4,271,249; 4,556,624; 4,557,991 and 4,604,338.

Moreover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014; and 4,394,430.

Although the above described toner and developer compositions are useful for their intended purposes, there is a need for improved compositions. More specifically, there is a need for toner compositions, including single component compositions which possess many of the advantages indicated herein. There is also a need for toner compositions with additives such as metal salts, or metal salts of fatty acids, as well as mixtures thereof with a sponge, or non-flake like morphology. These compositions are particularly useful in electrostatic imaging processes wherein blade cleaning is utilized for the removal of unwanted toner particles from the photoreceptor surface. In addition, there is a need for toner and developer compositions that maintain their triboelectrical characteristics for extended time periods exceeding, for example, 100,000 developed images. In addition, there is a need for toner and developer compositions, including color compositions that simultaneously maintain stable electrical characteristics for extended time periods, and maintain the toner triboelectric charge at a uniform value. Furthermore, there is a need for single component toners, and colored toners that possess many of the aforementioned characteristics. Also, there is a need for toner and developer compositions containing metal stearate charge control agents which do not cause either imagewise variations in developability or lack of development to high image output densities through excessive accumulation of such agents on the photoreceptor surface. Also, there is a need for toner and developer compositions containing lubricating agents with certain morphologies which provide appropriate lubrication of the receptor surface enabling use of blade cleaners but which do not lead to either imagewise variations in developability or lack of development to high image output densities through excessive accumulation of such lubricating agents on the surface of the photoreceptor.

SUMMARY OF THE INVENTION

It is an object of the present invention to provide toner and developer compositions which possess many of the advantages illustrated herein.

Another object of the present invention resides in the provision of toner and developer compositions with stable triboelectrical characteristics for extended time periods.

In another object of the present invention there are provided toner and developer compositions with additives such as metal salts or metal salts of fatty acids with a sponge, or non-flake like morphology.

Moreover, another object of the present invention relates to the provision of toner and developer compositions with charge enhancing additives permitting toner compositions with stable triboelectric values of from about 15 to about 35 microcoulombs per gram.

Also, in another object of the present invention there are provided toner and developer compositions with external additives of metal salts or metal salts of fatty acids with a sponge, or non-flake like morphology, such as, for example, with an aspect ratio of from about 1:1 to about 3:1.

Furthermore, in another object of the present invention there are provided positively or negatively charged toner and developer compositions useful for the development of images present on negatively or positively charged imaging members.

Additionally, in yet another object of the present invention there are provided toner and developer compositions with external additives of zinc stearate, magnesium stearate, and the like with a sponge like morphology, which compositions may contain other additives such as charge control agents and colloidal silicas.

In another object of the present invention there are provided positively or negatively charged toner compositions which are useful for causing the development of electrostatic latent images, including color images.

In yet another object of the present invention there are provided single component toner compositions.

In further object of the present invention there are provided colored toner and developer compositions.

Additionally, in still another object of the present invention there are provided methods for the development of images, including colored images, wherein blade cleaning of the imaging member is accomplished.

Additionally, in another object of the present invention there are provided toner and developer compositions which permit more repeatable high image densities and more uniform image densities particularly for images of low density and for color images.

These and other objects of the present invention are accomplished by providing developer compositions, and toner compositions comprised of resin particles, and metal salts of fatty acids, metal salts, or mixtures thereof with a certain morphology. More specifically, the present invention is directed to toner compositions comprised of resin particles, pigment particles, or colorants, inclusive of magnetites, metal salts of fatty acids, metal salts, or mixtures thereof with a sponge, or non-flake like morphology. In one embodiment of the present invention, there are provided toner compositions comprised of resin particles, pigment particles, and metal salts of fatty acids, metal salts, or mixtures thereof with a sponge, or non-flake like morphology, especially with an aspect ratio of from about 1:1 to about 3:1 such as zinc stearate, magnesium stearate, and the like. Furthermore, there are provided in accordance with the present invention positively charged toner compositions comprised of resin particles, pigment particles, charge enhancing additives, and metal salts of fatty acids, metal salts, or mixtures thereof with a sponge like morphology such as zinc stearate, magnesium stearate, and the like. Also, there is provided in accordance with the present invention toner compositions including colored toner compositions containing in addition to the sponge like morphology charge enhancing components, colloidal silicas, preferably as external surface components, and the like. Another embodiment of the present invention is directed to developer compositions comprised of the aforementioned toners, and carrier particles.

In addition, in accordance with preferred embodiments of the present invention there are provided developer compositions comprised of toner compositions containing resin particles, particularly styrene acrylates, styrene methacrylates, polyesters, styrene butadiene resins, or mixtures thereof; pigment particles such as magnetites, carbon blacks, or mixtures thereof; as external additives present in an amount, for example, of from about 0.1 to about 10 weight percent, metal salts of fatty acids, metal salts, or mixtures thereof with a sponge like morphology such as zinc stearate, magnesium stearate, and the like; optional charge enhancing components preferably incorporated into the toner in an amount of from about 0.1 to about 20 weight percent; and as optional external additives usually present in an amount of from about 0.1 to about 1 weight percent colloidal silicas such as Aerosil R972, reference U.S. Pat. No. 3,983,045, the disclosure of which is totally incorporated herein by reference. Examples of charge enhancing additives include, for example, distearyl dimethyl ammonium methyl sulfate, reference U.S. Pat. No. 4,560,635, the disclosure of which is totally incorporated herein by reference, and carrier particles. As preferred carrier components for the aforementioned compositions, there are selected steel or ferrite materials, particularly with a polymeric coating thereover including the coatings as illustrated in U.S. Ser. Nos. 136,792/87, and 136,791/87, the disclosures of which are totally incorporated herein by reference. One particularly preferred coating illustrated is comprised of a copolymer of vinyl chloride and trifluorochloroethylene with conductive substances dispersed in the polymeric coating inclusive of, for example, carbon black.

Illustrative examples of suitable toner resins selected for the toner and developer compositions of the present invention, and present in various effective amounts such as, for example, from about 70 percent by weight to about 95 percent by weight, include polyesters, polyamides, epoxy resins, polyurethanes, polyolefins, vinyl resins and polymeric esterification products of a dicarboxylic acid and a diol comprising a diphenol. Various suitable vinyl resins may be selected as the toner resin including homopolymers or copolymers of two or more vinyl monomers. Typical vinyl monomeric units include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; styrene butadiene copolymers, especially styrene butadiene copolymers prepared by a suspension polymerization process, reference U.S. Pat. No. 4,558,108, the disclosure of which is totally incorporated herein by reference; and mixtures thereof.

As one preferred toner resin there can be selected the esterification products of a dicarboxylic acid and a diol comprising a diphenol, which components are illustrated in U.S. Pat. No. 3,590,000, the disclosure of which is totally incorporated herein by reference. Other preferred toner resins included styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as Pliolites® from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol. Especially preferred resins include styrene n-butyl methacrylate (58/42, or 65/35), styrene butadiene (89/11, 87/13,91/9), Pliolites®, and the like.

Numerous well known suitable pigments, or dyes if appropriate can be selected as the colorant for the toner particles including, for example, carbon black, nigrosine dye, aniline blue, phthalocyanine derivatives, magnetites and mixtures thereof. The pigment, which is preferably carbon black, should be present in sufficient amount to render the toner composition colored thereby permitting the formulation of a clearly visible image. Generally, the pigment particles are present in amounts of from about 2 percent by weight to about 50 percent by weight, and preferably from about 5 to about 20 weight percent based on the total weight of the toner composition. However, lesser or greater amounts of pigment particles can be selected providing the objectives of the present invention are achieved.

When the pigment particles are comprised of magnetites, including those commercially available as Macpico Black®, they are present in the toner composition in an amount of from about 10 percent by weight to about 70 percent by weight, and preferably in an amount of from about 10 percent by weight to about 35 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black. Particularly preferred as pigments in some embodiments of the present invention are magnetites as they enable, for example, images with no toner spots for extended time periods exceeding the development of 50,000 images, which corresponds to about 200,000 imaging cycles for a panel containing four imaging members.

Also embraced within the scope of the present invention are colored toner compositions containing as pigments or colorants red, blue, green, brown, magenta, cyan, and/or yellow particles as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the color Index as CI 26050, CI Solvent Red 10, Lithol Scarlett, Hostaperm, and the like. Illustrative examples of cyane materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimiethoxy-4-sulfonanilide phenylazo-4'-chloro-2,5-dimethoxty aceto-acetanilide, Permanent Yellow FGL, red, blue, green, brown, Lithol Scralett, and the like. These pigments are generally present in the toner composition in an amount of from about 2 weight percent to about 15 weight percent based on the weight of the toner resin particles.

Illustrative examples of charge enhancing additives present in various effective amounts, such as example from about 0.1 to about 20 percent by weight, and preferably form about 1 to about 5 weight percent, include alkyl pyridinium khalides, such as cetyl pyridinium chlorides, reference U.S. Pat. No. 4,298,672, the disclosure of which is totally incorporated herein by reference, cetyl pyridinium tetrafluoroborates, quaternary ammonium sulfide, and sulfonate charge control agents as illustrated in U.S. Pat. No. 4,338,390, the disclosure of which is totally incorporated herein by reference, including stearyl phenethyl dimethyl ammonium tosylates; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like. Usually the charge additives are melt mixed with the aforementioned toner resins.

With further respect to the toner and developer compositions of the present invention, an important component present therein that enables many of the advantages illustrated herein to be obtained is the metal salt, metal salts of fatty acids, or mixtures thereof in fine particulate form having a sponge like, or non-flake like morphology. By particulate form having a sponge, or non-flake like morphology is meant in one embodiment particles which have aspect ratios (largest to shortest dimension) which are small (in the range up to approximately three to one) and characteristic of more three dimensional morphologies by comparison with typical metal stearate additives, which are comprised of particles which have aspect ratios which are large (greater than approximately three to one) and which are characteristic of more two dimensional or platelet like morphologies. The sponge like morphology is also characterized by a structure, which contains pores and/or small voids on the surface of the particles and within the particles. Also, the metal salt, or metal salt of fatty acid additives of the present invention as indicated herein preferably have an aspect ratio of from about 1:1 to about 3:1. Examples of stearates selected for the compositions of the present invention, which stearates are available from Fisher Scientific Inc., include zinc stearate, magnesium stearate, calcium stearate, mixtures thereof, and the like.

Advantages associated with the compositions of the present invention are as indicated herein and include excellent image density, reduced image ghosting, and increased image density uniformity.

The sponge like additives are preferably present in an amount of from about 0.1 to about 5 percent, and preferably from about 0.1 to about 1 percent, however, other amounts may be selected provided the objectives of the present invention are achievable. Also, these additives are present usually as external components. When present as external additives, the toner composition is initially formulated comprised of, for example, resin particles and pigment particles; and subsequently there is added thereto the sponge like additive components.

Illustrative examples of carrier particles that can be selected for mixing with the toner compositions of the present invention include those particles that are capable of triboelectrically obtaining a charge of opposite polarity to that of the toner particles. Accordingly, the carrier particles of the present invention can be selected so as to be of a negative polarity thereby enabling the toner particles, which are positively charged, to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922 relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a double polymer coating thereover, reference U.S. Ser. Nos. 136,792, and 136,791, the disclosures of which are totally incorporated herein by reference. More specifically, there is detailed in the aforementioned applications a process for the preparation of carrier particles with substantially stable conductively parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner compositions of the present invention can be prepared by a number of known methods, including mechanical blending and melts blending the toner resin particles, pigment particles or colorants, followed by mechanical attrition and the addition of the sponge like components by mixing. Other methods include those well known in the art such as spray drying, mechanical dispersion, melt dispersion, dispersion polymerization, extrusion, and suspension polymerization. In one specific embodiment, the toner compositions of the present invention are prepared by melt mixing at about 45° C. and 20 PSI ram pressure a mixture containing 88.5 percent by weight of polyester resin, reference U.S. Pat. No. 3,590,000, the disclosure of which is totally incorporated herein by reference, and 11.5 percent by weight of Black Pearls L carbon black, micronizing the resulting blend, and classifying the material to reduce the fines content resulting, for example, in toner particles with an average diameter of from about 5 to about 20, and preferably from about 10 to about 15 microns. Thereafter, there is added to the toner surface as an external additive, in an amount of 0.35 percent by weight, zinc stearate with flake like morphology, which stearate is available from Synpro. There can also be added to the toner surface as an external additive, in an amount of from about 0.1 to about 1, and preferably 0.65 percent by weight, colloidal silicas such as Aerosil R972.

The toner and developer compositions of the present invention may be selected for use in developing images in electrophotographic imaging systems, containing therein, for example, conventional photoreceptors, such as selenium and selenium alloys. Also useful, especially wherein there is selected positively charged toner compositions, and for reversal development modes wherein discharge area development is accomplished, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990. Other photoresponsive devices in the present invention include 4-dimethylaminovenzylidene, 2-benzylidene-amino-carbazole; 4-dimethamino-benzylidene; (2-nitro-benzylidene)-p-bromoaniline; 2,4-diphenyl-quazoline; 1,2,4-triazine; 1,5-diphenyl-3-methyl pyrazoline; 2-(4'-dimethyl-amino phenyl)-benzoaxzole; 3-aminocarbazole; hydrazone derivatives; polyvinyl carbazole-trinitrofluorenone charge transfer complex; and mixtures thereof. Moreover, there can be selected as photoconductors hydrogenated amorphous silicon; and as photogenerating pigments squaraines, perylenes, and the like.

Moreover, the toner and developer compositions of the present invention are particularly useful with electrophotographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the presence of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means, a transporting means, a development zone situated between the imaging means and the transporting means, the development zone containing therein electrically insulating magnetic carrier particles, means for causing the flexible imaging means to move at a speed of from about 5 cm/sec to about 50 cm/sec, means for causing the transporting means to move at a speed of from about 6 cm/sec to about 100 cm/sec, the means for imaging and the means for transporting moving at different speeds, and the means for imaging and the means for transporting having a distance therebetween of from about 0.05 millimeter to about 1.5 millimeters.

The following examples are being submitted to further define various species of the present invention. These examples are intended to illustrate and not limit the scope of the present invention. Also, parts and percentages are by weight unless otherwise indicated.

With respect to image quality, a number of different imaging characteristics are believed to be associated therewith, thus high image quality includes, but is not limited to, for example, substantially no background deposits on the resulting image copy; acceptable edge definition; excellent solid area density; line width; and halftone reproduction; and further, the images were nongrainy as determined by visual observation.

EXAMPLE I

There was prepared by melt extrusion at temperatures in the extruder between about 70° F. and 120° F. followed by mechanical attrition, a toner composition comprised of 90 percent by weight of a styrene butadiene resin, about 90 weight percent styrene, and 10 weight percent butadiene, and a 10 percent by weight magenta predispersion comprising 50 percent by weight Hostaperm Pink in styrene Methacrylate (65/35). Thereafter, there was added to the toner surface as an external additive, in an amount equal to 0.7 percent by weight, zinc stearate with flake like morphology, which zinc stearate is available from Synpro. The flake morphology was verified by scanning electron microscopy at 1,000 times and 10,000 times magnifications. The flake particles evidenced a size range of from about one micron to about ten microns in the largest dimension. Also, the aspect ratio of these particles exceeded 3 to 1. The flat nature of the flake or platelet like morphology of the particles was readily evident in the electron photomicrographs that were generated. There was also added to the toner surface as an external additive, in an amount of 0.5 percent by weight, Aerosil R972. Subsequently, there was prepared a developer composition by admixing the aforementioned formulated toner composition at a 3.5 percent toner concentration, that is 3.5 parts by weight of toner per 100 parts by weight of carrier, which carrier was comprised of an oxidized steel core with a coating thereover comprising 1.6 percent by weight of polymethylmethacrylate.

Thereafter, the formulated developer composition was incorporated into an electrostatographic Xerox Coporation 1075 TM imaging test device with a toner transporting means, a toner metering charging means, a development zone, and a cleaning blade as described in U.S. Pat. No. 4,394,429, the disclosure of which is totally incorporated herein by reference; and wherein the imaging member is comprised of an aluminum supporting substrate, a charge transporting layer comprising an alloy of selenium with about 0.5 percent by weight of arsenic and about 20 parts per million by weight of chlorine, and a photogenerating layer thereover comprising an alloy of selenium with about 10 percent by weight of tellurium. This member was negatively charged −20 microcoulombs per gram, and contained a latent image thereon. Ghosting resulted with the developed images as indicated herein.

EXAMPLE II

A toner and developer composition was prepared by repeating the procedure of Example I with the exception that there was selected magnesium stearate with a flake like morphology, available from Synpro, Inc., as a replacement for zinc stearate. Morphological characteristics of the particles were verified using scanning electron microscopy at 1,000 times and 10,000 times magnifications. The size range and shape of the magnesium stearate particles were closely similar to that observed for the flake like zinc stearate of Example I. Similar ghosting resulted as indicated in Example I.

EXAMPLE III

A toner and developer composition was prepared by repeating the procedure of Example I with the exception that there was selected magnesium stearate with a sponge like morphology obtained from Fisher Scientific as a replacement for zinc stearate. Morphological characteristics of the particles were verified using scanning electron microscopy at 1,000 times and 10,000 times magnifications. The particle size range for this magnesium stearate was comparable to that of Examples I and II in terms of the particles' largest dimensions. Also, the platelet or flake like character of the particles was completely absent and the aspect ratio (largest to smallest dimension) of the particles was smaller than for the stearates of Examples I and II, ranging from about 1 to 1 to about 3 to 1. A clearly defined sponge like morphology was also evident, the surface of the particles containing large numbers of open pores. From the examination of particle fragments over a large size range, it was evident that this porous structure extends through the body of the particles. No ghosting was observed after repeating the imaging process test of Example I.

EXAMPLE IV

A test procedure was developed to allow the quantitative evaluation of imaging performance with different toner compositions. images of selected test patterns were made using an electrostatographic imaging device as referenced in Example I. The voltage on the corona charging source was arranged to provide a charge potential in the development zone of about 800 volts on the photoreceptor in nondischarged areas. The intensity of the exposure system was adjusted to provide a potential in the development zone of about 150 volts on the photoreceptor following discharge by a white test pattern. The bias voltage on the development roll was maintained at 400 volts. One hundred (100) copies of a test pattern with extensive black and white areas were made with the electrophotographic system. These were followed by copies of a second test pattern having steps of increasing blackness or density starting with a white area. This test pattern was imaged using the same areas of the photoreceptor used to make the previous 100 copies of the first pattern, the steps of the second pattern extending over both areas of the photoreceptor corresponding to black and white areas of the first pattern. Measurements were made on the copies of the second pattern and on the photoreceptor. Measurements were made of image density for each copy of the second pattern, and of the charge on the photoreceptor before development of each copy. These measurements were made in all areas corresponding to the steps of different density of the second pattern. The density of the copy for some corresponding charge on the photoreceptor is a measure of the developability of the system Specifically, the developability is a measure of the ability of the development system to deposit toner in response to charge on the photoreceptor. In general, as the charge on the photoreceptor is increased the density of the image increases, ultimately reaching a point of saturation beyond which no further increase in density is observed. Comparison of developability for two areas on the copies of the second pattern corresponding to black and white areas on the first pattern respectively provided a measure of ghosting. If no ghosting was present, no difference in developability was seen, that is no difference was seen between the same step densities obtained from the black and white areas of the first pattern. If ghosting was present, then the pattern of the 100 copies from the first test document appeared on the copies of the second or step pattern. In general, where ghosting was present, the developability of a given density on the second pattern was higher in that area corresponding to a dark area on the first pattern.

There was prepared a toner and developer composition as described in Example III and measurements made of the developability and ghosting according to the above procedure. There were obtained images corresponding to high levels of developability in all areas of the imaged test pattern and less than a 0.01 developed density difference between areas in the 0.5 density patch of the second test pattern corresponding to black and white areas respectively of the first test pattern. Normal visual observations could not discern this difference and there was, therefore, essential absence of ghosting. These results are consistent with the superior imaging performance observed when using magnesium stearate as a toner additive with a sponge like morphology. Acceptable cleaning blade function as measured by no chatter or blade tuck was also maintained with this toner composition. Blade tuck represents the severe deformation of the blade edge under conditions where there is high frictional force between the blade edge and the photoreceptor. It results in elimination of blade cleaning functionality and leads to destruction of the cleaning blade and/or damage to the photoreceptor surface.

EXAMPLE V

There was prepared a toner and developer composition as described in Example II and measurements made of the developability and ghosting according to the procedure of Example IV. There were obtained images of the second pattern corresponding to black areas of the first pattern with developabilities comparable with those for the same areas in Example IV. There were obtained images of the second pattern corresponding to white areas of the first pattern with lower levels of developability than those observed in Example IV. There was measured a 0.02 developed density difference between areas in the 0.5 density patch of the second test pattern corresponding to black and white areas respectively of the first test pattern. This corresponds to a visually observable unacceptable level of ghosting. Cleaning blade function was comparable with Example IV.

EXAMPLE VI

There was prepared a toner and developer composition as described in Example I and measurements made of the developability and ghosting according to the procedure of Example IV. There were obtained images of the second pattern corresponding to black areas of the first pattern with developabilities comparable with those for the same areas in Example IV. There were obtained images of the second pattern corresponding to white areas of the first pattern with lower levels of developability than those observed in Example IV. There was measured a 0.07 developed density difference between areas in the 0.5 density patch of the second test pattern corresponding to black and white areas respectively of the first test pattern. This corresponds to a substantial and visually observable level of ghosting. These results are indicative of poor imaging performance. Cleaning blade function was comparable with Example IV.

EXAMPLE VII

There was prepared a toner and developer composition as described in Example I. Pure zinc stearate having a flake like morphology was then dusted by hand from a fabric pouch on to one half of the photoreceptor where the two halves of the photoreceptor were divided by a circumferential boundary line located equidistant axially from the two ends of the photoreceptor. The effect of dusting the stearate manually on one half of the drum was to generate a thick zinc stearate film on the photoreceptor by the subsequent action of the cleaning blade during rotation of the photoreceptor. Measurements of developability were then made according to the process described in Example IV but without the 100 copies of the first test pattern, that is copies were made using the second test pattern and measurements made of the image density of the copies for various charge levels on the photoreceptor for the two regions corresponding to the manually stearated and non-stearated regions of the photoreceptor respectively. Almost complete absence of developability was observed in the manually stearated region by comparison with the unstearated region of the photoreceptor. This result illustrates the role of a thick stearate film in diminishing developability of toner on the photoreceptor.

EXAMPLE VIII

A test procedure was defined to permit the evaluation of the impact of quantitatively different levels of stearate filming on developability for different toner compositions. A series of measurements were made according to the procedure described in Example IV. For each measurement in the series a different voltage bias was applied to the development roll during the production of the 100 copies of the first test pattern. The developer bias was varied over a range of from about 150 volts above the background voltage (image voltage on the photoreceptor in those regions corresponding to a white background on the test document) on the photoreceptor to about 450 volts above the background voltage on the photoreceptor. During imaging of the second test pattern the bias voltage on the development roll was maintained at 400 volts. The developability and ghosting were measured for a range of developer biases. Measurements of stearate film thickness by transmission electron microscopy and by secondary ion mass spectroscopy indicated that stearate film thickness increased monotonically with increasing voltage bias on the development roll. The series of measurements defined by the procedure of this Example therefore permit the evaluation of developability and ghosting performance for varying levels of stearate film thickness and evaluation of the propensity to develop stearate films of different thicknesses in an imagewise fashion due to repeated imaging of a particular test pattern or series of test patterns on the photoreceptor.

EXAMPLE IX

There was prepared a toner and developer composition as described in Example I. Measurements of developability and ghosting were made according to the procedure described in Example VIII. At all development voltage biases there was observed significant loss of developability in areas of the second pattern corresponding to white areas of the first pattern. No developability loss was noted in areas of the second pattern corresponding to black areas of the first pattern. Thus, there was measured a ghosting level for the 450 volt developer bias corresponding to 0.145 developed density difference between areas in the 0.5 density patch of the second test pattern corresponding to black and white areas respectively of the first test pattern. The loss of developability and level of ghosting increased monotonically with increasing developer bias over the range from 150 volts to 450 volts.

EXAMPLE X

There was prepared a toner and developer composition as described in Example II. Measurements of developability and ghosting were made according to the procedure described in Example VIII. At all development voltage biases there was observed significant loss of developability in areas of the second pattern corresponding to white areas of the first pattern. No developability loss was noted in areas of the second pattern corresponding to black areas of the first pattern. Thus, there was measured a ghosting level for the 450 volt developer bias corresponding to 0.095 developed density difference between areas in the 0.5 density patch of the second test pattern corresponding to black and white areas respectively of the first test pattern. The loss of developability and level of ghosting increased monotonically with increasing developer bias over the bias range from 150 volts to 450 volts.

EXAMPLE XI

There was prepared a toner and developer composition as described in Example III. Measurements of developability and ghosting were made according to the procedure described in Example VIII. The loss of developability in all areas and level of ghosting were almost unmeasureable for biases in the voltage range up to approximately 400 volts. At the 450 volt developer bias level there was measured a 0.015 developed density difference between areas in the 0.5 density patch of the second test pattern corresponding to black and white areas respectively of the first test pattern. The results of this Example indicate the superior performance over the specified development bias range with regard to developability loss and ghosting for the toner with sponge like magnesium stearate morphology as compared to stearate materials with flake like morphology, reference Example VIII.

EXAMPLE XII

There was prepared by melt blending at a temperature of about 45° F. and an operating ram pressure of 20 PSI, followed by mechanical attrition, a toner composition comprised of 88.5 percent by weight of polyester and 11.5 percent by weight of Black Pearls L carbon black. Thereafter, there was added to the toner surface as an external additive, in an amount equal to 0.35 percent by weight, zinc stearate with flake like morphology, which zinc stearate is available from Synpro. The flake morphology was verified by scanning electron microscopy at 1,000 times and 10,000 times magnifications. The flake like particles showed a size range of from about one micron to about 10 microns in the largest dimension. The flat nature of the flake or platelet like morphology of the particles was readily evident in the electron photomicrographs. There was also added to the toner surface as an external additive, in an amount of 0.65 percent by weight, Aerosil R972. Subsequently, there was prepared a developer composition by admixing the aforementioned formulated toner composition at a 3.5 percent toner concentration, that is 3.5 parts by weight of toner per 100 parts by weight of carrier, which carrier was comprised of an oxidized steel core with a coating thereover comprising 1.6 percent by weight of polymethylmethacrylate.

EXAMPLE XIII

There was prepared a toner and developer composition as described in Example XII with the exception that there was selected in place of the zinc stearate the magnesium stearate described in Example III with a sponge like morphology obtained from Fisher Scientific.

EXAMPLE XIV

There was prepared a toner and developer composition as described in Example XIII and measurements made of the developability and ghosting according to the procedure of Example IV excepting that the bias on the development roll was maintained at 750 volts while running the 100 prints of the first test pattern, and at 400 volts during imaging of the second test pattern. There were obtained images with high levels of developability for all areas of the imaged test pattern and less than 0.01 developed density difference between areas in the 0.5 density patch of the second test pattern corresponding to black and white areas respectively of the first test pattern. Normal visual observations could not discern this difference and there was therefore essential absence of ghosting. These results are consistent with the superior imaging performance observed when using toner with magnesium stearate having a sponge like morphology. Excellent cleaning blade function as measured by no chatter or blade tuck was also maintained with this toner composition.

EXAMPLE XV

There was prepared a toner and developer composition as described in Example XII and measurements made of the developability and ghosting according to the procedure of Example IV excepting that the bias on the development roll was maintained at 750 volts while running the 100 prints of the first test pattern, and at 400 volts during imaging of the second test pattern. There were obtained images of the second pattern corresponding to black areas of the first pattern with developabilities comparable with those for the same areas in Example XIV. There were obtained images of the second pattern corresponding to white areas of the first pattern with lower levels of developability than those observed in Example XIV. There was measured a 0.20 developed density difference between areas in the 0.5 density patch of the second test pattern corresponding to black and white areas respectively of the first test pattern. This corresponds to a substantial and visually observable level of unacceptable ghosting. These results are indicative of the relatively poor imaging performance. Cleaning blade function was comparable to that of Example XIV.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of resin particles, and a component with a sponge, or non-flake like morphology selected from the group consisting of metal salts, of fatty acids, and mixtures thereof.

2. A toner composition comprised of resin particles, and a component with a sponge, or non-flake like morphology, and an aspect ratio of from about 1:1 to about 3:1 selected from the group consisting of metal salts, of fatty acids, and mixtures thereof.

3. A toner composition in accordance with claim 1 wherein said component comprises a sponge like morphology.

4. A toner composition in accordance with claim 1 wherein the component is present in an amount of from about 0.1 to about 5 weight percent.

5. A toner composition in accordance with claim 1 wherein the component is zinc stearate, or magnesium stearate.

6. A toner composition in accordance with claim 1 wherein the resin particles are selected from the group consisting of styrene acrylate, styrene methacrylates, styrene butadienes, a polyester resulting from the condensation reaction of dimethylterephthalate, 1,2-propanediol, 1,3-butanediol, and pentaerythritol; and a polyester resulting from the condensation reaction of dimethylterephthalate, 1,2-propanediol, diethylene glycol, and pentaerythritol.

7. A toner composition in accordance with claim 2 wherein the resin particles are selected from the group consisting of styrene acrylates, styrene methacrylates, styrene butadienes, a polyester resulting from the condensation reaction of dimethylterephthalate, 1,2-propanediol, 1,3-butanediol, and pentaerythritol; and a polyester resulting from the condensation reaction of dimethylterephthalate, 1,2-propanediol, diethylene glycol, and pentaerythritol.

8. A toner composition in accordance with claim 1 containing pigment particles which are selected from the group consisting of carbon black, magnetite, cyan, magenta, yellow, or mixtures thereof.

9. A toner composition in accordance with claim 2 containing pigment particles which are selected from the group consisting of carbon black, magnetite, cyan, magenta, yellow, or mixtures thereof.

10. A toner composition in accordance with claim 1 containing charge enhancing additives.

11. A toner composition in accordance with claim 2 containing charge enhancing additives.

12. A toner composition in accordance with claim 1 containing colloidal silicas.

13. A toner composition in accordance with claim 12 wherein the silicas are present in an amount of from about 0.1 to about 1 weight percent.

14. A toner composition in accordance with claim 10 wherein the charge enhancing additive is selected from the group consisting of distearyl dimethyl ammonium methyl sulfate, cetyl pyridinium halides, and stearyl phenethyl dimethyl ammonium tosylate.

15. A developer composition comprised of the toner composition of claim 1, and carrier particles.

16. A developer composition comprised of the toner composition of claim 2, and carrier particles.

17. A developer composition comprised of the toner composition of claim 9, and carrier particles.

18. A developer composition in accordance with claim 15 wherein the carrier particles are comprised of a core with a polymeric coating thereover.

19. A developer composition in accordance with claim 16 wherein the carrier particles are comprised of a core with a polymeric coating thereover.

20. A developer composition in accordance with claim 16 wherein the carrier particles are comprised of a steel or a ferrite core with a coating thereover selected from the group consisting of polychlorotrifluoroethylene-co-vinylchloride copolymer, a polyvinylidene fluoropolymer, or a terpolymer of styrene, methacrylate, and an organo silane, fluorinated ethylene-propylene copolymers, and polytetrafluoroethylene.

21. A developer composition in accordance with claim 17 wherein the carrier particles are comprised of a steel or a ferrite core with a coating thereover selected from the group consisting of polychlorotrifluoroethylene-co-vinylchloride copolymer, a polyvinylidene fluoropolymer, or a terpolymer of styrene, methacrylate, and an organo silane, fluorinated ethylene-propylene copolymers, and polytetrafluoroethylene.

22. A method for obtaining images which comprises generating an electrostatic latent image on a photoconductive imaging member, subsequently effecting development of this image with the toner composition of claim 1, thereafter transferring the image to a permanent substrate, and optionally permanently affixing the image thereto.

23. A method for obtaining images which comprises generating an electrostatic latent image on a photoconductive imaging member, subsequently effecting development of this image with the toner composition of claim 2, thereafter transferring the image to a permanent substrate, and optionally permanently affixing the image thereto.

24. A method of imaging in accordance with claim 22 wherein blade cleaning is selected.

25. A method of imaging in accordance with claim 23 wherein blade cleaning is selected.

26. A method of imaging in accordance with claim 23 wherein there results substantially no image smearing, or ghosting.

27. A method of imaging in accordance with claim 23 wherein developability remains substantially constant.

28. A method of imaging in accordance with claim 23 wherein developability remains substantially constant for 1,000,000 imaging cycles.

29. A method of imaging in accordance with claim 23 wherein image quality is insensitive to the magnitude of the difference between the developer bias and the background voltage on the photoreceptor which magnetitude is from about 50 to about 450 volts for fixed development potentials.

30. A method of imaging in accordance with claim 24 wherein the cleaning blade maintains the photoreceptor substantially free of toner debris and there is sufficient lubrication between the blade and the photoreceptor to permit smooth travel of the blade edge over the photoreceptor surface without vibration or chatter means repeated moving and sticking.

31. A toner composition in accordance with claim 8 wherein the mixture contains from about 6 percent by weight of magnetite to about 70 percent by weight of magnetite, and from about 3 percent by weight to about 15 percent by weight of carbon black.

32. A toner composition comprised of resin, pigment, and a component with a sponge or non-flake like morphology selected from the group consisting of metal salts, of fatty acids and mixtures thereof.

33. A toner comprised of resin, pigment, and metal salts of fatty acids with a sponge or non-flake like morphology.

34. A toner composition in accordance with claim 33 wherein the metal salts of fatty acids have an aspect ratio of from about 1:1 to about 3:1.

35. A toner composition comprised of resin, pigment, and zinc stearate with a sponge or non-flake like morphology.

36. A toner composition comprised of resin, pigment, and magnesium stearate with a sponge or non-flake like morphology.

37. A toner composition comprised of resin, pigment, and calcium stearate with a sponge or non-flake like morphology.

38. A toner in accordance with claim 35 wherein the zinc stearate has an aspect ratio of from about 1:1 to about 3:1.

39. A toner in accordance with claim 36 wherein the magnesium stearate has an aspect ratio of from about 1:1 to about 3:1.

40. A toner in accordance with claim 37 wherein the calcium stearate has an aspect ratio of from about 1:1 to about 3:1.

* * * * *